United States Patent [19]

Smith et al.

[11] 3,955,533

[45] May 11, 1976

[54] SQUEEGEE ROLLER SYSTEM FOR REMOVING EXCESS DEVELOPER LIQUID FROM PHOTOCONDUCTIVE SURFACES

[76] Inventors: Ian E. Smith, Lockleys; Dennis I. Scroggs, Para Hills, both of Australia

[22] Filed: Sept. 3, 1974

[21] Appl. No.: 502,815

Related U.S. Application Data

[63] Continuation of Ser. No. 292,625, Sept. 27, 1972, abandoned.

[52] U.S. Cl. ..... 118/637; 118/DIG. 23; 355/15; 427/15

[51] Int. Cl.² ..... G03G 15/10

[58] Field of Search ..... 118/637, DIG. 23; 117/17.5; 355/15, 10, 3 PP

[56] References Cited

UNITED STATES PATENTS

| | | | |
|---|---|---|---|
| 3,384,051 | 5/1968 | Hunstiger | 118/DIG. 23 |
| 3,701,337 | 10/1972 | Borelli et al. | 118/637 |
| 3,764,208 | 10/1973 | Takahashi et al. | 118/637 |
| 3,776,632 | 12/1973 | Smith et al. | 355/15 |
| 3,807,853 | 4/1974 | Hudson | 355/15 |

OTHER PUBLICATIONS

IBM Technical Disclosure Bulletin, Davidge et al., Force Loaded Cleaning Station, Vol. 16, No. 4, 9/73, pp. 1265–1266.

IBM Technical Disclosure Bulletin, Bullock et al., Photoconductor Cleaning Station, Vol. 16, No. 4, 9/73, pp. 1268–1270

*Primary Examiner*—Mervin Stein
*Assistant Examiner*—Douglas Salser
*Attorney, Agent, or Firm*—Henry L. Shenier

[57] ABSTRACT

A squeegee roller system for removing excess developer liquid from the developed-image-bearing photoconductive surface of a drum or the like in which a freely rotatable squeegee roller having a covering of predetermined hardness is biased against the drum to cause excess developer to flow into a receptacle having a weir over which the liquid flows back to the supply tank and in which a fur or pile-covered cleaning roller contacting the squeegee roller is driven in the opposite direction from and at a speed slightly greater than that at which the drum drives the squeegee roller with lower portions of both rollers passing through developer liquid retained by the weir and in which a cleaning blade is biased into engagement with the cleaning roller.

5 Claims, 4 Drawing Figures

SQUEEGEE ROLLER SYSTEM FOR REMOVING EXCESS DEVELOPER LIQUID FROM PHOTOCONDUCTIVE SURFACES

This is a continuation of application Ser. No. 292,625, filed Sept. 27, 1972, now abandoned.

BACKGROUND OF THE INVENTION

Our copending application Ser. No. 155,108 filed June 21, 1971, now U.S. Pat. No. 3,839,032, discloses a method and apparatus for the making of electrostatic prints of an original by a contact transfer method. More particularly in the system disclosed in the copending application a photoconductive surface such as that formed on a drum first is moved past a corona which applies a uniform electrostatic charge over the surface moving thereby. Next the charged surface is exposed to an image of the original to cause the charge to leak off in areas which are not to be developed. The resultant latent electrostatic image is then subjected to the action of a liquid developer made up of particles of a relatively tacky toner suspended in a light hydrocarbon carrier liquid. When the image has been developed, it is transferred onto a sheet or length of copy material by pressing the copy material against the image-bearing surface. Owing to the greater affinity of the tacky toner for the copy material than for the photoconductor surface the image is transferred onto the copy material.

Proper transfer of the developed image from the photoconductive surface to the copy material requires that no excess developer liquid be present in the region at which the transfer takes place. Moreover, if pollution of the surrounding atmosphere is to be avoided excess hydrocarbon liquid should be removed from the surface as soon after development as is possible. Various systems have been proposed for removing the excess developer liquid from the developed-image-bearing photoconductive surface. Our copending application Ser. No. 200,433 filed Nov. 19, 1971, now U.S. Pat. No. 3,741,643, discloses a Pneumatic Assembly for Removing Excess Developer Liquid from Photoconductive Surfaces. More particularly, that copending application discloses and claims an air knife for directing a stream of air against the developed-image-bearing surface to drive excess liquid back toward the overflow tray of the developer unit. As is pointed out in the copending application one of the problems which has risen in excess developer liquid removal systems is the tendency of the excess developer removal unit to collect particles of toner which cause a buildup which after a period of time in use of the machine renders the cleaning system ineffective. While the system shown in our copending application effectively removes excess developer liquid from an image-bearing photoconductive surface it is not as effective as is desirable. Moreover it requires the provision of a blower for producing air under pressure to feed the air knife. It further tends to pollute the air within the machine cabinet.

We have invented an improved system for removing excess developer liquid from a photoconductive surface. Our system removes excess liquid from the developed-image-bearing surface without disturbing the image. Our improved system removes such a substantial amount of excess liquid as to minimize the possibilities of pollution. It does not require any separate supply of compressed air. It will operate for a relatively long period of time without maintenance. It is relatively simple in construction for the result achieved thereby.

SUMMARY OF THE INVENTION

One object of our invention is to provide a squeegee roller system for removing excess developer liquid from a photoconductive surface.

Another object of our invention is to provide a squeegee roller system for removing excess developer liquid from a photoconductive surface more effectively than do proposed liquid developer removal systems of the prior art.

A further object of our invention is to provide a squeegee roller system for removing excess developer liquid from a photoconductive surface which does not require a separate source of compressed air.

Still another object of our invention is to provide a squeegee roller system for removing excess developer liquid from a photoconductive surface without disturbing the toner image on the surface.

Yet another object of our invention is to provide a squeegee roller system for removing excess developer liquid from a photoconductive surface which system operates for a relatively long period of time without maintenance.

A still further object of our invention is to provide a squeegee roller system for removing excess developer liquid from a photoconductive surface without polluting the space within a machine cabinet.

Other and further objects of our invention would appear from the following description.

In general our invention contemplates the provision of a squeegee roller system for removing excess developer liquid from a photoconductive surface in which a squeegee roller having a surface covering of a predetermined hardness is biased with a predetermined force against the moving surface carrying a developed electrostatic image so as to be driven thereby and in which a pile or fur-covered cleaning roll is driven in the opposite direction to and at a slightly greater speed than the squeegee roller itself so as to produce a cleaning action with the lower portions of both rollers immersed in developer liquid retained by a weir prior to being returned to the supply and in which a blade is urged into engagement with the surface of the cleaning roll.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
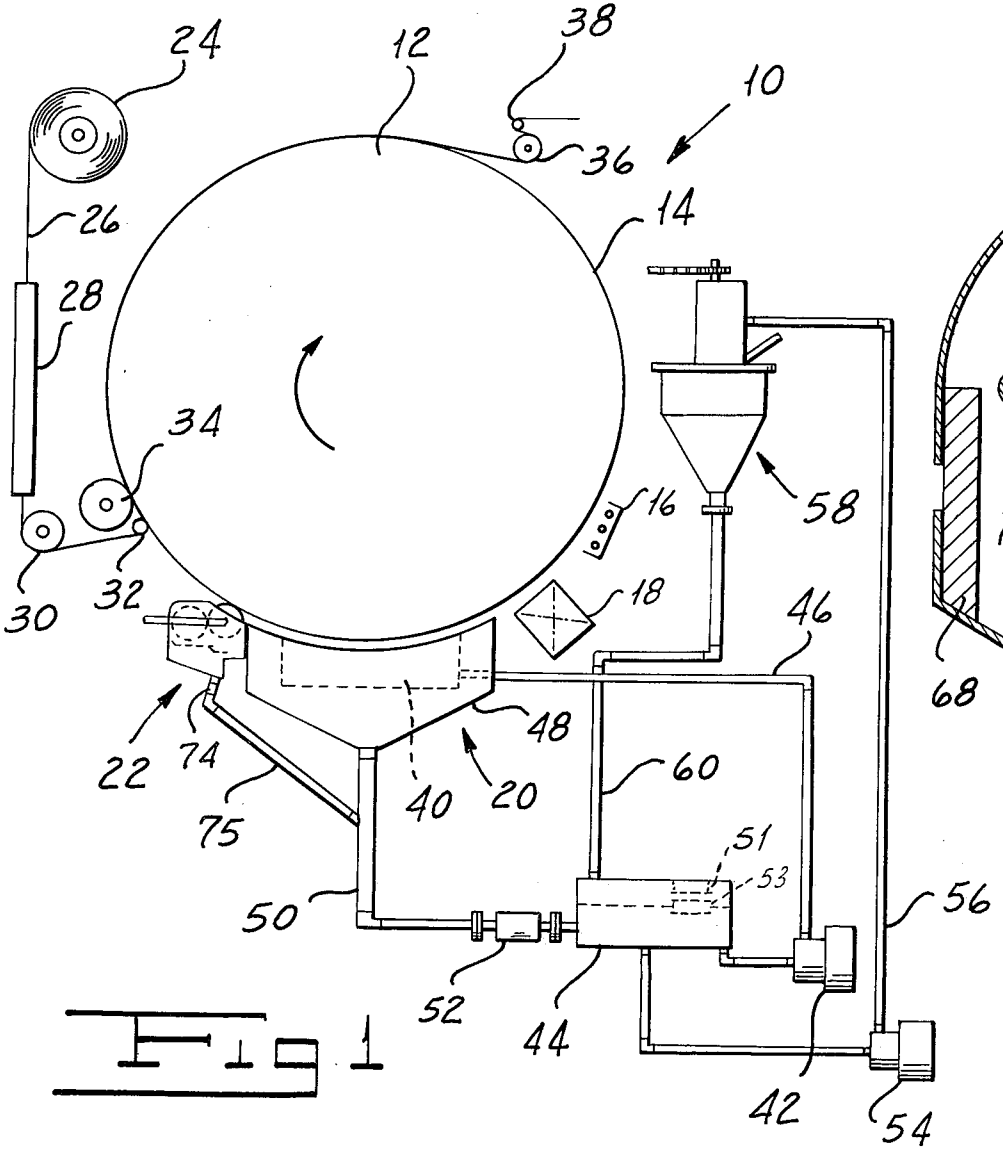
FIG. 1 is a partially schematic view of an electrostatic copying machine provided with our squeegee roller system for removing excess developer liquid from a photoconductive surface.

Referring now to FIG. 1 of the drawings one electrostatic copying machine indicated generally by the reference character 10 with which our squeegee roller system may be employed includes a drum 12 having a photoconductive surface 14. In operation of the machine 10 the drum is driven in the direction of the arrow shown in FIG. 1 to move the surface 14 past a corona unit 16 which applies a uniform electric charge to the surface. After leaving the corona the surface 14 passes an exposure unit 18 which focuses an image of the original to be copied on to the surface. In response to the image there is produced on the surface a latent electrostatic image. After leaving the exposure station the surface passes through a developer system indicated generally by the reference character 20 which applies a developer liquid over the latent electrostatic image. The developer applied by the system 20 is made up of a light hydrocarbon carrier liquid in which particles of a tacky toner are suspended. The system thus far described is more fully disclosed in the first of our two copending applications referred to hereinabove. After leaving the developing unit 20 the developed-image-bearing surface passes by our squeegee roller system indicated generally by the reference character 22 to be described more fully hereinafter.

Upon leaving the squeegee roller system 22 the surface bearing the tacky image is moved into contact with a copy medium such as plain paper. For example, a roll 24 of paper 26 may be fed through a heater 28 and around respective guide rolls 30 and 32 and into the nip between a pressure roll 34 and the drum 12 to bring the image into intimate contact with the paper 26. Owing to the greater affinity of the tacky toner for the paper 26 than for the surface 14 the developed image is transferred to the paper 26. After the image has been transferred to the paper the paper moves around respective guide rolls 36 and 38 and past a suitable cutting mechanism (not shown) and to a location at which the copy is delivered to the user.

A pump 42 supplies developer liquid from a tank 44 through a line 46 to the applicator portion 40 of the developer unit 20. Excess developer spills over the edges of the applicator unit 40 and into a recovery tray 48 from which the excess developer flows back to the tank 44 through a return line 50 in which we place a monitoring unit 52.

A second pump 54 circulates developer liquid from the tank 44 through a line 56 and through a toner mill indicated generally by the reference character 58 back to a return line 60 leading to the tank 44. The toner mill 58 may be of any suitable type known to the art. In the response to operation of the monitoring unit 52 additional toner is supplied to the mill 58 in the manner known to the art. A liquid level switch 51 responsive to a float 53 in tank 44 may actuate a system (not shown) for adding liquid hydrocarbon carrier to the mill 58. The arrangement thus far described is shown in greater detail in the first of our copending applications referred to hereinabove. It will not be described in greater detail since it does not per se form a part of our invention.

Figure 3:
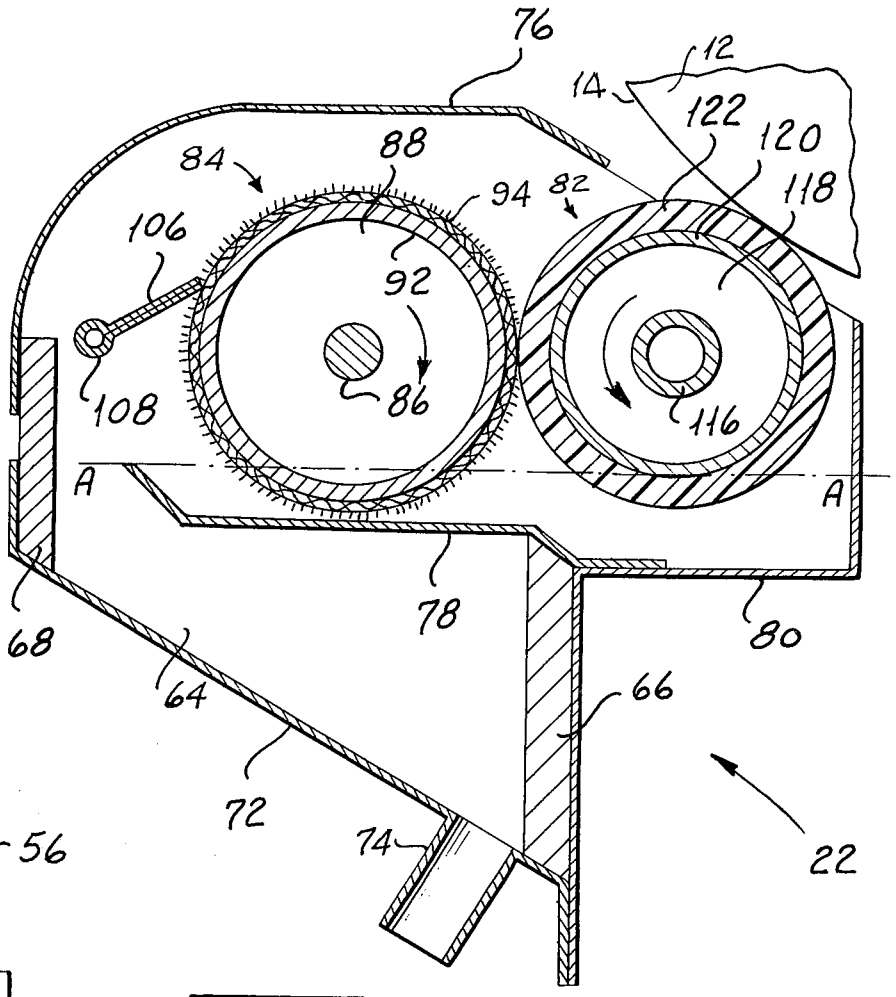
FIG. 3 is a sectional view of the form of our squeegee roller system illustrated in FIG. 2.
Figure 2:
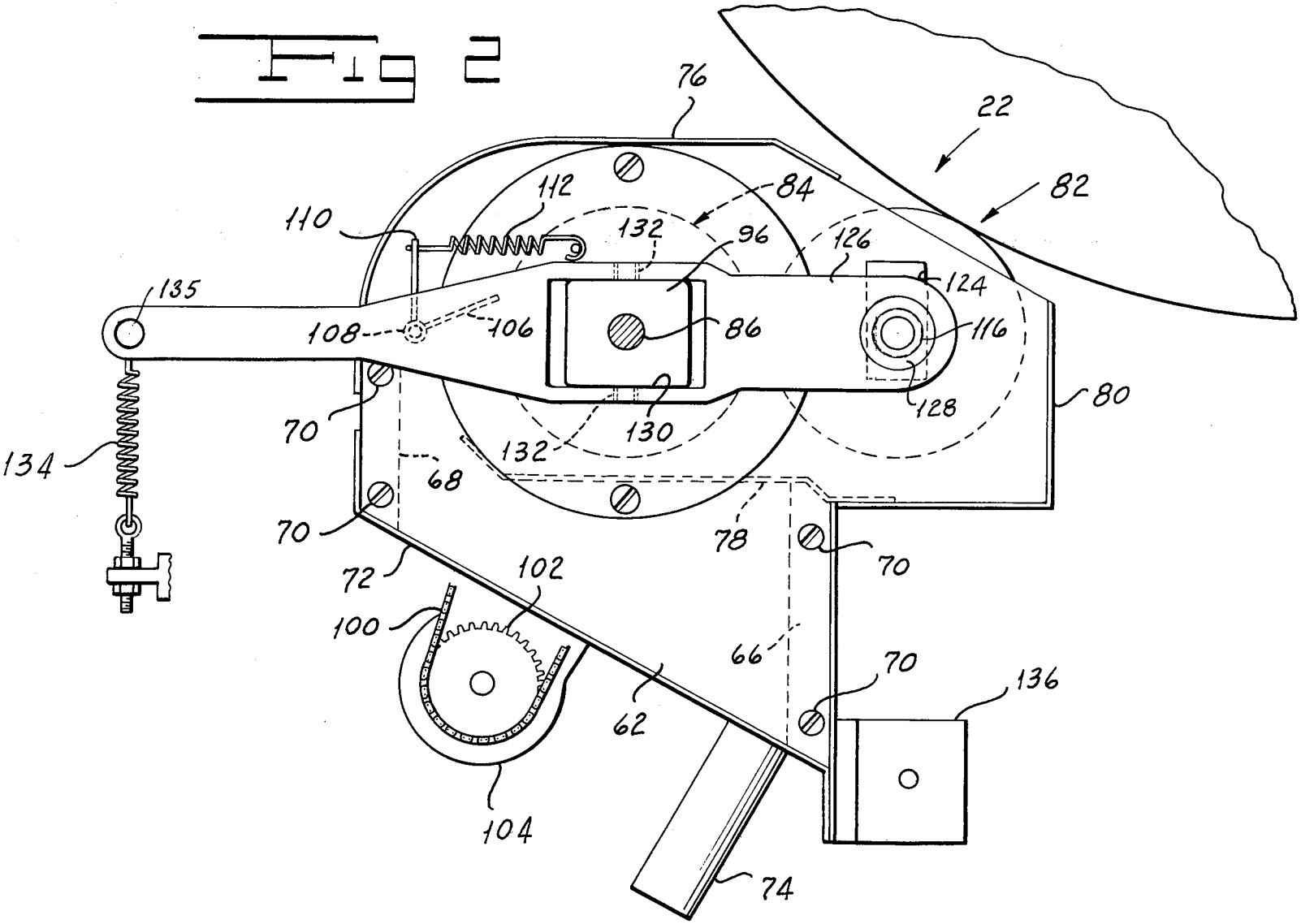
FIG. 2 is a side elevation of our squeegee roller system for removing excess developer liquid from a photoconductive surface.
Figure 4:
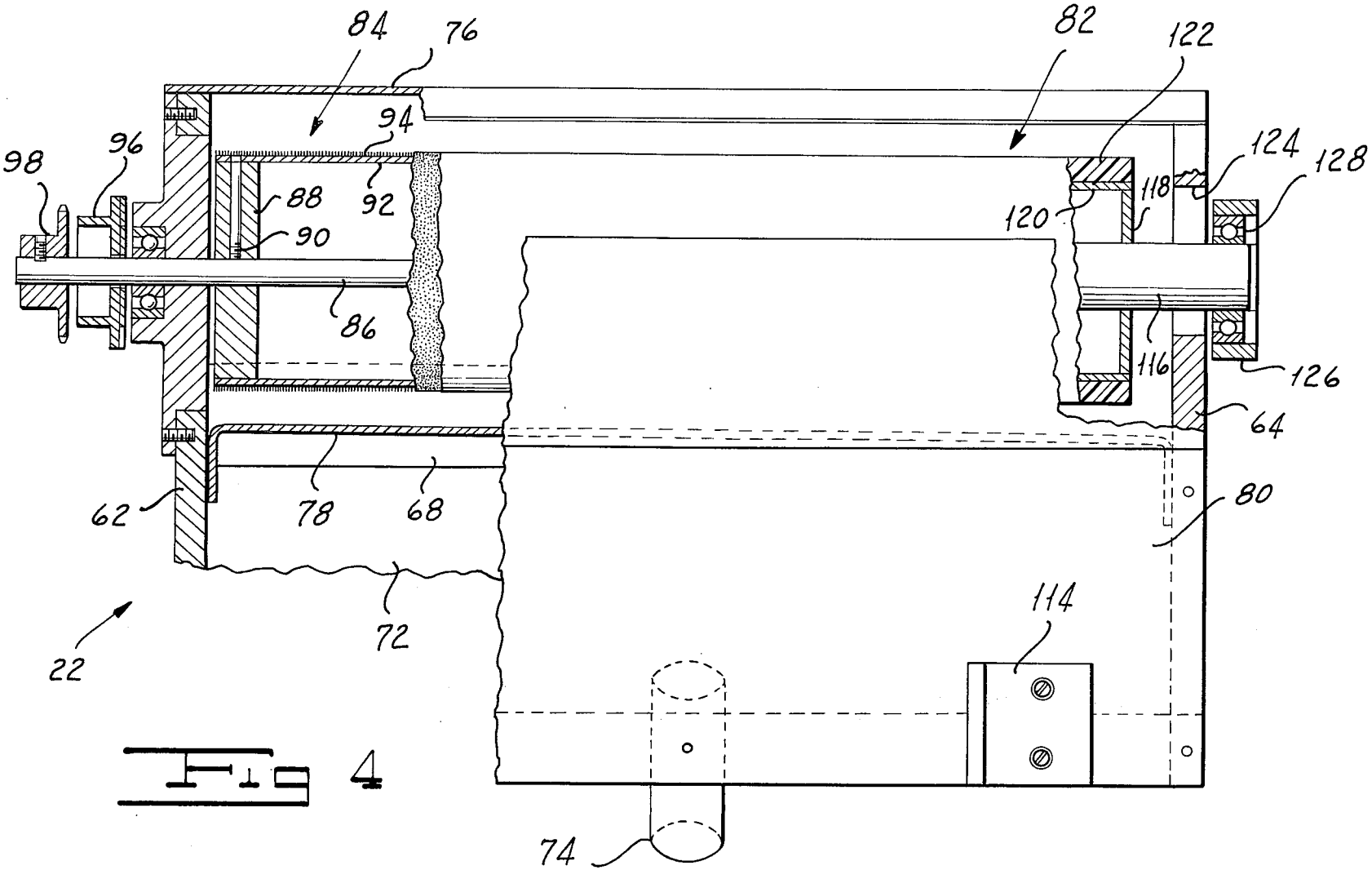
FIG. 4 is a front elevation of our squeegee roller system with parts broken away and with other parts shown in section.

Referring now to FIGS. 2 to 4 our squeegee roller system includes a pair of side plates 62 and 64 secured to the ends of front and back plates 66 and 68 by any suitable means such as by screws 70 or the like. A sheet metal bottom 72 riveted or otherwise secured to the front, back and side plates provides an outlet 74 for developer liquid. A line 75 connects outlet 74 to the return line 50 of the developer system 20. In this manner excess developer removed from the surface 14 by the system 22 is returned to the supply tank.

We rivet a weir forming plate 78 to the assembly to retain liquid developer in the system 22 to a predetermined level as will be described more fully hereinbelow. We secure a cover plate 76 to the assembly to cover most of the top thereof. We rivet or otherwise secure a front splash plate 80 to the assembly.

The system 22 includes a squeegee roller indicated generally by the reference character 82 and a cleaner roller indicated generally by the reference character 84. End plates 62 and 64 rotatably support the cleaner roller shaft 86. Roller 84 includes end plates 88 secured to shaft 86 for rotation therewith by any suitable means such as by set screws 90. Plates 88 support a metal cylinder 92 which is covered with a covering 94 of "fur" nylon fabric wound diagonally onto the tube 92 and bonded thereon with a suitable adhesive.

Shaft 86 extends beyond the end plates 62 and 64 rotatably to receive respective lever mounting members 96 to be described in detail hereinbelow. One end of the shaft 86 receives a sprocket wheel 98 which is driven by a chain 100 extending around a second sprocket wheel 102 carried by the shaft of a motor 104.

A shaft 108 carries a wiper blade 106 adapted to engage the surface of the cleaner roll 84. Preferably we provide one end of the shaft 108 with an arm 110 which receives one end of a spring 112 which biases the blade 106 into engagement with the surface of the roller 84.

The squeegee roll 82 includes a hollow shaft 116 carrying spaced end plates 118 which support a metal cylinder 120. The metal cylinder 120 is provided with a cover 122 of polyurethane rubber or the like having a durometer hardness of between about 20 and 23. The shaft 116 extends outwardly through openings 124 in the respective side plates 62 and 64 and into bearings 128 carried by the ends of a pair of loading levers 126 located at opposite sides of the unit 22. We provide the levers 126 with openings 130 for receiving the mounting blocks 96. Preferably the openings 130 are slightly longer than are the blocks 96 to permit some adjustment of the lever position on shaft 86. Any suitable means such, for example, as set screws 132 may be employed to secure the blocks 96 in position in the openings 130. It will be appreciated that by virtue of this arrangement just described the levers 126 are pivotally supported on shaft 86 and the squeegee roll 82 is rotatably supported on the loading levers 130.

We load the ends of arms 126 remote from the squeegee roll 82 so as to bias the squeegee roll 82 into engagement with surface 14 with a predetermined force. This may be accomplished by any suitable means. We might for example place weights on the ends of the levers remote from the squeegee roll. Alternatively we provide an adjustable loading spring 134 which engages a rod 135 extending between arms 126. The assembly of unit 22 may be mounted directly on the overflow tank 48 by any suitable means such for example as by brackets 136.

In operation of our squeegee roller system for removing excess developer liquid from a photoconductive surface the spring 134 or other suitable means is adjusted to bias the squeegee roll 82 into engagement with the surface 14 of the drum 12 with a predetermined force. When the machine is operating the drum 12 moves with a surface speed of about 45 feet per minute. In response to that rotation of the drum the squeegee roller is driven at a speed of approximately 86 revolutions per minute. Owing to the engagement of the squeegee roller with the drum excess developer liquid is squeezed out of the nip to flow downwardly into the receptacle formed by the assembly of the component parts of the excess liquid removal system. This liquid is retained by the weir plate 78 to a level indicated by the line A—A in FIG. 3. Additional liquid flows over the weir and downwardly and out through line 75 back to the supply system.

Preferably we drive the cleaning roll 84 at a speed which is slightly greater than and in the direction opposite to that of the squeegee roll 82 as indicated by the arrows in FIG. 3. For example, motor 104 may be so regulated as to drive the cleaning roll at approximately 90 revolutions per minute. In response to this movement the surface of the roll 84 moves slightly faster than does the surface of the roll 82 so that the nap or fur provided by the covering 94 produces a scrubbing action against the surface of the squeegee roll. At the same time excess liquid is wiped off the surface of the roll 84 by the blade 106. It will be appreciated also that the lower portions of both the rolls are immersed in the developer liquid being held in the system by the weir plate 78.

It will be seen we have accomplished the objects of our invention. We have provided a squeegee roller system for removing excess developer liquid from a photoconductive surface. Our system is arranged to remove excess liquid without disturbing the image. Substantially all of the excess liquid is removed so that transfer of the image to a sheet of copy material is facilitated. Our arrangement does not require a separate source of compressed air. It does not contribute appreciably to pollution in the machine housing. It is relatively simple in construction and in operation for the result achieved thereby.

It will be understood that certain features and subcombinations are of utility and may be employed without reference to other features and subcombinations. This is contemplates by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In an electrostatic copying machine having a member provided with a photoconductive surface adapted to receive a latent electrostatic image and a developer system adapted to apply liquid developer to said surface at a developing location and means for moving said surface relative to said developer system to carry said image past said developing location, apparatus including a squeegee roller, means mounting said squeegee roller for freely rotatable movement in engagement with said surface at a location spaced beyond said developing location whereby said squeegee roller is driven by said member independently of any other drive means, a cleaning roller, means mounting said cleaning roller for rotary movement in operative relationship with the surface of said squeegee roller, a receptacle for receiving liquid removed from said surface by said squeegee roller, means for retaining removed liquid in said receptacle to a certain level, said roller mounting means mounting said rollers in said receptacle with portions of the rollers immersed in said retained liquid and means for driving said cleaning roller in a direction opposite to and at a speed slightly greater than the direction and speed at which said squeegee roller is driven by said surface.

2. Apparatus as in claim 1 in which said squeegee roller mounting means mounts said squeegee roller for movement toward and away from said surface and means biasing said squeegee roller into engagement with said surface with a predetermined force.

3. Apparatus as in claim 2 in which said cleaning roller mounting means comprises a shaft and in which said squeegee roller mounting means comprises a pair of arms carried by said shaft for rotation relative thereto.

4. Apparatus as in claim 3 in which said squeegee roller comprises an elastomeric covering of a predetermined hardness and in which said cleaning roller comprises a pile-like covering.

5. Apparatus as in claim 4 including a cleaning blade in engagement with the surface of said cleaning roller.

* * * * *

UNITED STATES PATENT AND TRADEMARK OFFICE

CERTIFICATE OF CORRECTION

PATENT NO. : 3,955,533

DATED : May 11, 1976

INVENTOR(S) : Ian E. Smith and Dennis I. Scroggs

It is certified that error appears in the above-identified patent and that said Letters Patent are hereby corrected as shown below:

This patent should have issued in the name of the Assignee, SAVIN BUSINESS MACHINES CORPORATION, Valhalla, New York, instead of the individual applicants.

Signed and Sealed this

Fourteenth Day of September 1976

[SEAL]

*Attest:*

RUTH C. MASON
*Attesting Officer*

C. MARSHALL DANN
*Commissioner of Patents and Trademarks*